US011125538B2

(12) United States Patent
Alexandre et al.

(10) Patent No.: US 11,125,538 B2
(45) Date of Patent: Sep. 21, 2021

(54) SHOOTING RANGE FACILITY FOR RECREATIONAL OR SPORTING PURPOSES WITH A TILTING TARGET SUPPORT, METHOD FOR CONFIGURING SUCH A FACILITY

(71) Applicant: Commissariat a l'energie atomique et aux energies alternatives, Paris (FR)

(72) Inventors: Jean-Marc Alexandre, Verrieres-le-Buisson (FR); Robert Boden, Dourdan (FR); Christian Bolzmacher, Montrouge (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 25 days.

(21) Appl. No.: 16/618,294

(22) PCT Filed: May 31, 2018

(86) PCT No.: PCT/FR2018/051253

§ 371 (c)(1),
(2) Date: Nov. 29, 2019

(87) PCT Pub. No.: WO2018/220329

PCT Pub. Date: Dec. 6, 2018

(65) Prior Publication Data

US 2021/0072001 A1 Mar. 11, 2021

(30) Foreign Application Priority Data

Jun. 2, 2017 (FR) ..... 1754911

(51) Int. Cl.
*F41J 1/10* (2006.01)
*F41J 1/00* (2006.01)

(52) U.S. Cl.
CPC .. *F41J 1/10* (2013.01); *F41J 1/00* (2013.01)

(58) Field of Classification Search
CPC ..... F41J 1/00; F41J 1/10; F41J 9/14; F41J 11/00

(Continued)

(56) References Cited

U.S. PATENT DOCUMENTS 4,917,388 A * 4/1990 Marquardt ..... F41J 7/04 273/392
6,367,800 B1 4/2002 Sheck et al.

(Continued)

FOREIGN PATENT DOCUMENTS

DE 93 13 702.8 U1 11/1993

OTHER PUBLICATIONS

International Search Report dated Jul. 17, 2018 in PCT/FR2018/051253 filed May 13, 2018, 3 pages.

*Primary Examiner* — Laura Davison
(74) *Attorney, Agent, or Firm* — Oblon, McClelland, Maier & Neustadt, L.L.P.

(57) ABSTRACT

A shooting range facility that is for recreational or sporting purposes includes a target support plate, which can be tilted according to several different possible inclinations with respect to a reference plane, and at least one target representation intended to be displayed in a plane of the target support plate. Each target representation has several different displayable deformations, respectively associated with the several different possible inclinations, these different deformations being designed so that the orthogonal projections thereof in the reference plane are all identical when they are respectively displayed in the plane of the target support plate according to the inclinations with which they are respectively associated.

12 Claims, 2 Drawing Sheets

(58) Field of Classification Search
USPC ..... 273/358
See application file for complete search history.

(56) References Cited

U.S. PATENT DOCUMENTS

| | | | | |
|---|---|---|---|---|
| 6,933,930 | B2 | 8/2005 | Devige et al. | |
| 10,048,043 | B2 * | 8/2018 | Rahmanian | H04N 9/3141 |
| 2003/0066692 | A1 | 4/2003 | Devige et al. | |
| 2008/0174071 | A1 * | 7/2008 | Potterfield | F41J 7/04 273/392 |
| 2013/0234395 | A1 | 9/2013 | Mickelson et al. | |
| 2015/0268013 | A1 | 9/2015 | Heise | |
| 2016/0209184 | A1 * | 7/2016 | Anderson | F41J 7/04 |
| 2018/0087881 | A1 * | 3/2018 | Bickel | F41J 5/18 |

* cited by examiner

SHOOTING RANGE FACILITY FOR RECREATIONAL OR SPORTING PURPOSES WITH A TILTING TARGET SUPPORT, METHOD FOR CONFIGURING SUCH A FACILITY

BACKGROUND

The present invention relates to a shooting range facility for recreational or sporting purposes with a tilting target support. It also relates to a method for configuring such a facility.

It relates more precisely to a shooting range facility for recreational or sporting purposes that comprises a target support plate, which can be tilted according to several different possible inclinations with respect to a reference plane, and at least one target representation intended to be displayed in a plane of the target support plate.

Many types of shooting range facilities for recreational or sporting purposes are known. Some have a target support plate that is resistant to impacts and sets of carton target representations to be fastened against a front face of the support plate. Each carton target representation must then be replaced after each use and there is no simple interactivity with the shooter who must regularly move towards the target or move it towards him. Others have an interactive face and electronic means for locating impacts against the interactive face. The interactivity with the shooter is then substantially improved since the locating data obtained electronically can be transmitted in real time to the shooter via a telecommunications channel (on a mobile telephone or other portable device for example). It is for example known to use: optical techniques, via an optical scanner or laser beams; infrared technologies with the interruption of modulated beams; techniques for detecting progressive mechanical waves, in particular based on the measurement of a difference in transit time of a Lamb wave packet generated by an impact to a plurality of piezoelectric detectors and on the deterministic calculation, using a pre-established mathematical formula, of the position of a an emitting source of the wave packet. These latter techniques for detecting progressive mechanical waves, such as for example disclosed in U.S. Pat. No. 6,933,930 B2, are moreover generally preferred in terms of shooting range for recreational or sporting purposes because they allow for the use of interactive faces that are both resistant and sensitive to impacts. Furthermore, they do not require any consumable items.

Regardless of the type of facility chosen, the target representation is preferably displayed by default in a reference plane perpendicular to the desired axis of sight and/or of shooting. Thus, it appears as is and without deformation to the eyes of a shooter. But in practice, in particular for the facilities with interactive faces for locating impacts, it is preferable to tilt the target support plate, as disclosed in U.S. Pat. No. 6,367,800 B1: not only to possibly redirect the projectiles into a recovery bin, but also to protect the impact surface from impacts with excessively strong power or energy. Indeed, the higher the inclination is in relation to the reference plane defined hereinabove, according to one or several freely chosen axes, the more the impact energy is reduced via deviation of the trajectory of the projectile without stopping it, which has the effect of increasing the resistance of the plate to strong powers/energies and therefore the duration of its life.

But such an inclination deforms the target representation when it is viewed in the desired sight and/or shooting axis. However then it is necessary to detach the impact surface (which can be tilted) from the target representation (remaining displayed in the reference plane), and this gives rise to obvious problems for locating the impacts due to parallax errors.

BRIEF SUMMARY

It may thus be desired to design a shooting range facility for recreational or sporting purposes that makes it possible to overcome at least one portion of the aforementioned problems and constraints.

A shooting range facility for recreational or sporting purposes is therefore proposed comprising:

- a target support plate which can be tilted according to several different possible inclinations with respect to a reference plane,
- at least one target representation intended to be displayed in a plane of the target support plate, wherein each target representation has several different displayable deformations, respectively associated with said several different possible inclinations, these different deformations being designed so that the orthogonal projections thereof in the reference plane are all identical when they are respectively displayed in the plane of the target support plate according to the inclinations with which they are respectively associated.

Thus, regardless of the inclination chosen from among the possible inclinations, each desired target representation can be seen without apparent deformation in an axis, of sight and/or of shooting, perpendicular to the desired reference plane. This makes it possible to protect the impact surface, in particular from powerful shots with powder or compressed air propulsion systems, without harming the presentation of the target which, in certain disciplines, furthermore satisfies strict requirements in terms of dimensions and proportions.

Optionally, each deformation of each target representation is reproduced on a prefabricated specific support intended to be removably arranged against the target support plate.

Also optionally, a shooting range facility for recreational or sporting purposes according to the invention can further comprise:

- a calculator programmed to calculate each deformation of each target representation using at least one angular value that corresponds to the inclination associated with this deformation, and
- a device for electronically displaying each deformation calculated by the calculator.

Also optionally, a shooting range facility for recreational or sporting purposes according to the invention can further comprise a detector of the inclination of the target support plate for the supply of said at least one angular value, the calculator then being programmed to calculate the deformation of each target representation corresponding to the inclination detected by angular correction using said at least one angular value supplied by the inclination detector.

Also optionally, the target support plate can be tilted angularly around a first main axis of the reference plane, in particular intended to be substantially horizontal when the facility is installed on the ground, and/or around a second axis of the reference plane, perpendicular to the first main axis.

Also optionally:

- any inclination of angle $\alpha$ around the first main axis generates a corresponding proportional geometrical deformation in $(\cos \alpha)^{-1}$ in the direction orthogonal to the first main axis of each target representation, and/or any inclination of angle β around the second axis generates a corresponding proportional geometrical deformation in $(\cos \beta)^{-1}$ in the direction orthogonal to the second axis of each target representation.

Also optionally, a shooting range facility for recreational or sporting purposes according to the invention can further comprise:

a shooting power recorder, a device for adjusting the inclination of the target support plate according to the shooting power recorded, and an adapter of the target representation deformation displayed according to the adjusted inclination.

Also optionally, the target support plate is transparent or translucent, has a front frosted face and has a rear face against which is intended to be projected said at least one target representation in order to form the display plane of the target support plate.

Also optionally, a shooting range facility for recreational or sporting purposes according to the invention can further comprise:

a device for locating shooting impacts, several target representations that reproduce the same pattern but intended to be centered on respectively several target centers located at different places on the display plane of the target support plate, means for recording successive locations and powers of shooting impacts supplied by the device for locating, and means for selecting a target center location for a selected display according to the successive locations and powers of shooting impacts recorded.

A method for configuring a shooting range facility for recreational or sporting purposes is also proposed comprising a target support plate which can be tilted according to least one non-zero inclination with respect to a reference plane and at least one reference target representation intended to be displayed in a plane of the plate when the latter is parallel to the reference plane, the method for configuring being such that:

at least one deformation of said at least one reference target representation is calculated using at least one angular value corresponding to said at least one non-zero inclination in such a way that the orthogonal projection of this deformation in the reference plane is identical to the reference target representation when the deformation is tilted according to said at least one angular value, and said at least one calculated deformation is displayed in the plane of the plate when the latter is tilted according to said at least one angular value.

BRIEF DESCRIPTION OF THE DRAWINGS

The invention shall be better understood using the following description, given solely by way of example and given in reference to the accompanying drawings wherein.

DETAILED DESCRIPTION

Figure 1:
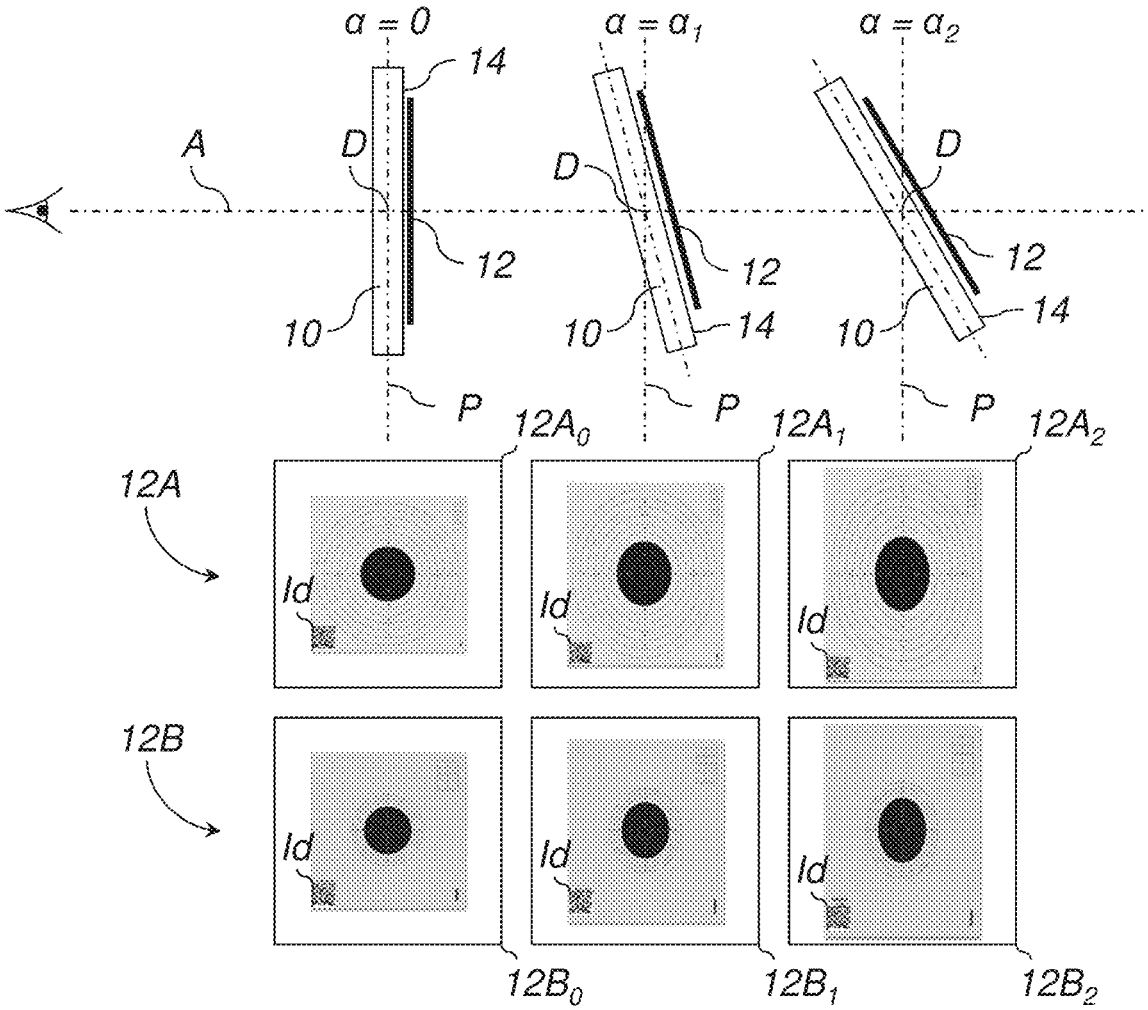
FIGS. 1 and 2 diagrammatically show the general structure of a shooting range facility for recreational or sporting purposes according to two embodiments of the invention, FIGS. 3 and 4 diagrammatically and partially show alternative embodiments of the facility of FIG. 2.

The shooting range facility for recreational or sporting purposes diagrammatically shown in FIG. 1 relates to a shooting activity for recreational or sporting purposes with a weapon, rifle or pistol, with compressed air or a powder, as well as to a shooting activity of archery, crossbow, blowgun, dart or other.

It comprises a target support plate 10 shown as a side view, which can be tilted according to several different possible inclinations (for example $\alpha=0$, $\alpha=\alpha_1$, $\alpha=\alpha_2$) with respect to a reference plane P. This reference plane P is shown vertical and perpendicular to an axis A of sight and/or of shooting itself shown horizontally in the plane of the figure. By way of an example that is simple to show but not limiting, three different possible inclinations are shown in FIG. 1, all three around a horizontal axis D of the reference plane P and identified by an angular value α. The first inclination is zero ($\alpha=0$), the second takes a value $\alpha_1$ (for example 15 degrees) for a and the third a value $\alpha_2$ (for example 30 degrees).

The shooting range facility for recreational or sporting purposes further comprises at least one target representation 12 intended to be displayed in a plane 14 of the target support plate 10, for example a rear face of the plate 10. Its fastening will not be given in detail as it is perfectly known per se. This arrangement advantageously makes it possible to protect the target representation 12, the plate 10 then needing to be transparent. Alternatively, the display plane 14 is the front face of the plate 10 with the latter then able to be opaque.

Under the three possible inclinations shown in FIG. 1 are shown several target representations with each one having several different displayable deformations and associated respectively with the different possible inclinations. According to the non-limiting example of this figure, two different target representations are provided.

A first target representation 12A is a target for shooting sports with a pistol at 10 meters. It has three deformations, each one reproduced for example on a prefabricated specific support made of paper or of carton and intended to be arranged by removable fastening against the front or rear face 14 of the target support plate 10. The first deformation $\mathbf{12}A_0$, zero and corresponding to the zero inclination $\alpha=0$, represents concentric circles numbered on a carton support with minimum dimensions 170 mm×170 mm, with a visual black disc of 59.5 mm (+/−0.2 mm) in diameter from the zone 7 to the zone 10 in accordance with Olympic standards. It is intended to be displayed on the front or rear face 14 of the target support plate 10 when the latter is parallel to the reference plane P. The second deformation $\mathbf{12}A_1$, corresponding to the non-zero inclination $\alpha=\alpha_1$, shows concentric ellipses deformed in such a way that their orthogonal projection in the reference plane P is identical to the concentric circles of the first zero deformation $\mathbf{12}A_0$ when this second deformation is displayed on the front or rear face 14 of the target support plate 10 according to the inclination $\alpha=\alpha_1$ with which it is associated. Finally, The third deformation $\mathbf{12}A_2$, corresponding to the non-zero inclination $\alpha=\alpha_2$, shows concentric ellipses deformed in such a way that their orthogonal projection in the reference plane P is identical to the concentric circles of the first zero deformation $\mathbf{12}A_0$ when this third deformation is displayed on the front or rear face 14 of the target support plate 10 according to the inclination $\alpha=\alpha_2$ with which it is associated.

A second target representation 12B is a target for shooting sports with a rifle at 10 meters. It has three deformations, each one reproduced on a prefabricated specific support made of paper or carton and intended to be arranged by removable fastening against the front or rear face 14 of the target support plate 10. The first deformation 12$B_0$, zero and corresponding to the zero inclination $\alpha=0$, represents concentric circles numbered on a carton support with minimum dimensions 80 mm×80 mm, with a visual black disc of 30.5 mm (+/−0.1 mm) in diameter from the zone 4 to the zone 9 in accordance with Olympic standards. It is intended to be displayed on the front or rear face 14 of the target support plate 10 when the latter is parallel to the reference plane P. The second deformation 12$B_1$, corresponding to the non-zero inclination $\alpha=\alpha_1$, shows concentric ellipses deformed in such a way that their orthogonal projection in the reference plane P is identical to the concentric circles of the first zero deformation 128$_0$ when this second deformation is displayed on the front or rear face 14 of the target support plate 10 according to inclination $\alpha=\alpha_1$ with which it is associated. Finally, The third deformation 12$B_2$, corresponding to the non-zero inclination $\alpha=\alpha_2$, shows concentric ellipses deformed in such a way that their orthogonal projection in the reference plane P is identical to the concentric circles of the first zero deformation 12$B_0$ when this third deformation is displayed on the front or rear face 14 of the target support plate 10 according to the inclination $\alpha=\alpha_2$ with which it is associated.

In practice, the deformations are established in the following way: any inclination of angle $\alpha$ around the axis D generates a corresponding proportional geometrical deformation in $(\cos\alpha)^{-1}$ in the direction orthogonal to D. According to this geometrical deformation, if F(x,y) denotes the first zero deformation of any target representation (x being the abscissa along the axis D and y the ordinate in the orthogonal direction), then the deformation G(x,y) resulting from an inclination $\alpha$ around the axis D is given by the following relationship:

$$F(x,y)=G(x,y\cdot(\cos\alpha)^{-1}).$$

This results in that, in accordance with a first aspect of this invention, the possible deformations of the same target representation are such that the orthogonal projections thereof in the reference plane P are all identical when they are respectively displayed in the plane of the target support plate according to the inclinations with which they are respectively associated.

Of course, the target representations, compliant or not with Olympic standards, are multiple. For example:

for shooting sports with a pistol at 25 and 50 meters: the first deformation, zero and corresponding to the zero inclination $\alpha=0$, represents concentric circles numbered on a carton support of minimum dimensions 550 mm×550 mm, with a black visual disc of 200 mm (+/−1 mm) in diameter from the zone 7 to the zone 10 in accordance with Olympic standards, for shooting sports with a high-speed pistol at 25 metres: the first deformation, zero and corresponding to the zero inclination $\alpha=0$, represents concentric circles numbered on a carton support of minimum dimensions 550 mm×550 mm, with a black visual disc of 500 mm (+/−2 mm) in diameter from the zone 5 to the zone 10 in accordance with Olympic standards, for shooting sports with a rifle at 50 meters: the first deformation, zero and corresponding to the zero inclination $\alpha=0$, represents concentric circles numbered on a carton support of minimum dimensions 250 mm×250 mm, with a black visual disc of 112.40 mm (+/−0.5 mm) in diameter in accordance with Olympic standards, for shooting sports with a rifle at 300 meters: the first deformation, zero and corresponding to the zero inclination $\alpha=0$, represents concentric circles numbered on a carton support of minimum dimensions 1020 mm×1020 mm, with a black visual disc of 600 mm (+/−3 mm) in diameter from the zone 5 to the zone 10 in accordance with Olympic standards.

Nothing prevents providing representations of targets that are purely recreational and entirely of any kind, that do not in particular reproduce concentric sight circles with zero deformation.

Moreover, each support made of paper, carton or other of each deformation of each target representation can comprise an identifier Id such as a barcode that makes it possible to effectively retrieve to which target representation and to which inclination it corresponds. The facility of FIG. 1 is thus provided with a set of target representations 12 with several possible deformations all identified with a barcode and which can be displayed on the front or rear face 14 of the target support plate 10 according to the desired shooting discipline and inclination.

Figure 2:
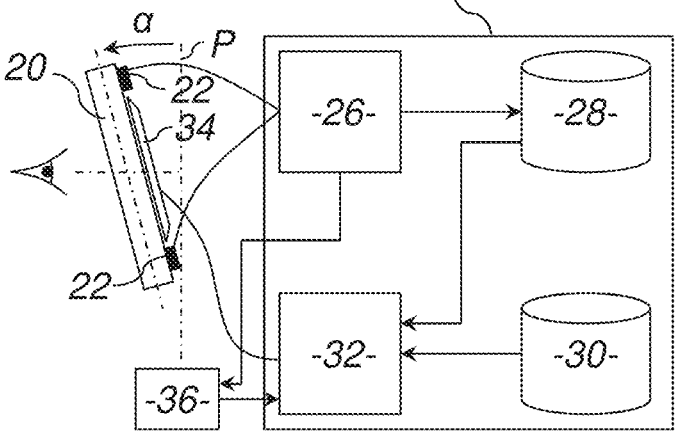

The shooting range facility for recreational or sporting purposes shown diagrammatically in FIG. 2 is compliant with an embodiment without consumable items wherein an electronic device is provided to display a desired target representation and calculate the deformation thereof beforehand. In this case, the target can be a fixed image or an animated series of images. This is furthermore an embodiment in which the locating of the impact is carried out using an interactive face for receiving impacts and electronic means for locating, in particular via differential transit time calculations. It relates to the same activities as the facility of FIG. 1.

This facility also comprises a target support plate 20 which can be tilted according to several different possible inclinations in relation to reference plane P defined hereinabove. This plate 20 has an interactive surface that is able to propagate progressive mechanical waves from an impact. Moreover, several transducers 22 are distributed at the rear against the plate 20: at least three, even generally four, transducers are thus arranged in order to allow for a locating via triangulation using signals that they transmit. They are indeed designed to capture the progressive mechanical waves that propagate in the interactive surface and transform them into electrical signals.

The facility of FIG. 2 further comprises an electronic central unit 24, connected to the transducers 22 for receiving the electrical signals thereof, programmed to locate any impact in the interactive surface of the plate 20 via an analysis of differences in the propagation times of the progressive mechanical waves coming from the impact to the transducers 22 based on impact detection instants identified in the electrical signals received. The electronic central unit 24 comprises for this purpose a first calculator 26 for locating impacts which, optionally, can furthermore provide an estimate of the power of each impact located. Each impact detected can then be stored in memory 28 with its location and its power in order to form a history of the impacts.

The electronic central unit 24 further comprises a memory 30 for storing at least one target representation intended to be displayed in a desired plane of the target support plate 20.

Each target representation is thus stored in digital format and a second calculator 32 of the electronic central unit 24 is programmed to calculate each possible deformation of each target representation using at least one angular value corresponding to an inclination of the plate 20 associated with this deformation.

A device 34 for electronically displaying, in the desired plane of the plate 20, of each deformation calculated by the second calculator 32 is furthermore provided and connected to the electronic central unit 24. In the illustration of FIG. 2, the electronic display device 34, for example a computer screen, an interactive tablet or any flat screen connected to the second calculator 32, is arranged against the rear face of the target support plate 20, the latter then having to be transparent.

But many other alternatives are possible for designing the target support plate 20 and the electronic display device 34 in this embodiment. First of all, a single and same interactive screen can perform both functions. It must then be solid enough to withstand the impacts. It is also possible to provide a protective case with an interactive front face inside of which is arranged an electronic display screen. It is also possible to provide a display of each deformation calculated by the second calculator 32 via projection or retroprojection onto the target support plate 20.

Optionally but advantageously, the facility of FIG. 2 further comprises a detector 36 of the inclination (conventional inclinometer or any other equivalent device) of the target support plate 20 for the supplying of at least one angular value $\alpha$ of the inclination of its display plane, the second calculator 32 then being programmed to calculate the deformation of each target representation corresponding to the inclination detected by angular correction using said at least one angular value supplied by the inclination detector 36.

Optionally but also advantageously, the inclination detector 36 can further perform a function of adjusting the inclination of the target support plate 20 according to a shooting power recorded. Since this power can indeed by measured and recorded by the first calculator 26, it can therefore be used to automatically adjust the inclination: the latter will be for example be low in as much as the last power recorded is low, for better sensitivity in the locating of impacts, and stronger in as much as the last power recorded is high, for a better protection of the impact surface of the plate 20. It is furthermore suitable to adjust the inclination in order to obtain the best compromise between the size of the impact surface and the reduction in the impact power. Once the inclination is thus adjusted, the second calculator 32 adapts the target representation deformation displayed according to the adjusted inclination.

Figure 3:
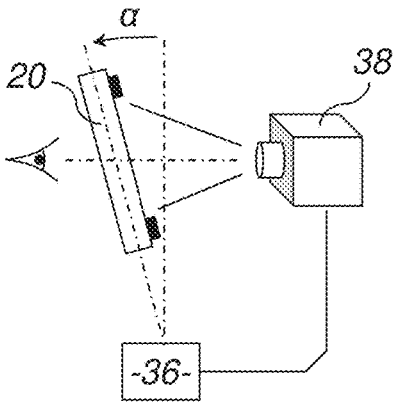

FIG. 3 shows the aforementioned alternative according to which each deformation calculated by the second calculator 32 is displayed via retroprojection on the rear face of the target support plate 20. A projection device 38 is placed at the rear of the plate 20 which is then preferably transparent and frosted. The projection device 38 can include the electronic central unit 24 or be connected to it. According to another aspect of the present invention, different and independent from the first, the front face of the plate 20, intended to receive the impacts of shots, is frosted. In this way, the images that are retroprojected on its rear face are formed on the front face without any parallax error. Furthermore, a frosted front face has the advantage of being less sensitive to the impacts than a transparent face which is altered over the course of time. It can moreover be maintained easily by providing light maintenance with sandpaper in order to remove alterations or deposits.

Figure 4:
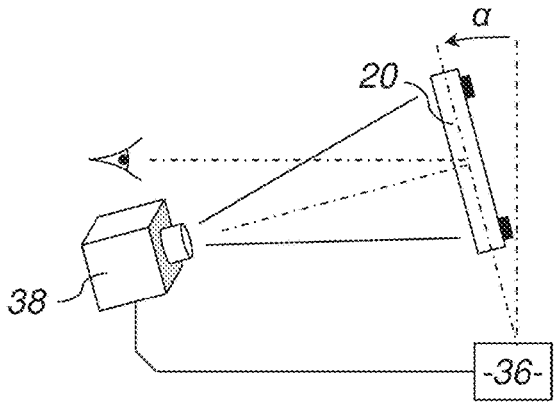

FIG. 4 shows the aforementioned alternative according to which each deformation calculated by the second calculator 32 is displayed via projection on the front face of the target support plate 20. The projection device 38 is then placed in front of the plate 20 which is preferably opaque or frosted.

The projection device 38 is for example an image projector. It can also be a video projector. A laser projector can also be chosen to project an image with a high contrast, in particular to form a circle that can be seen from a distance.

Figure 5:
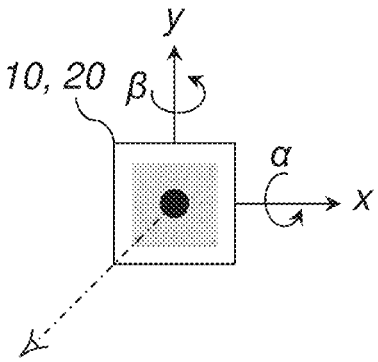
FIG. 5 shows inclination possibilities of the facility of FIG. 1 or 2, FIGS. 6 and 7 show possibilities for displaying deformed representations of targets by the facility of FIG. 1 or 2.

As shown in FIG. 5, the target support plate 10 or 20 can be angularly tilted around several axes, in particular two axes, of the reference plane P. A first main axis of the reference plane P, for example the one which is intended to be substantially horizontal when the facility is installed on the ground, is the axis D of FIG. 1, identified by the x axis of FIG. 5, around which the inclination is measured using the angular value $\alpha$ defined hereinabove. A second axis of the reference plane P around which the target support plate 10 or 20 can be tilted is the y axis of FIG. 5, perpendicular to the x axis and intended to be substantially vertical when the facility is installed on the ground. The inclination around this y axis is measured using an angular value $\beta$. Any inclination of angle $\alpha$ around the x axis generates a corresponding proportional geometrical deformation in $(\cos\alpha)^{-1}$ in the direction of the y axis for $\beta=0$. Likewise, any inclination of angle $\beta$ around the y axis generates a corresponding proportional geometrical deformation in $(\cos\beta)^{-1}$ in the direction of the x axis for $\alpha=0$.

On the other hand the deformation G(x,y) resulting from an inclination $\alpha$ around the x axis and $\beta$ around the y axis is given by the following relationship, which is simply demonstrated by geometrical considerations:

$$F(x,y)=G(x\cdot(\cos\beta)^{-1}+y\cdot(tg\alpha)\cdot(tg\beta),y\cdot(\cos\alpha)^{-1}).$$

Here $F(x, y)=G(x, y\cdot(\cos\alpha)^{-1})$ for $\beta=0$ and $F(x, y)=G(x(\cos\beta)^{-1}, y)$ for $\alpha=0$.

The advantage of providing two separate axes of inclination is to make use of two inclinations in order to reduce the power of the impacts. With a single axis, the higher the inclination is, the more the perceived size of the target representation is rapidly reduced in such a way that beyond a certain limit, it becomes problematic to display representations of which the dimensions can be regulated. With two axes, the decrease in size with the increase in the power of the impacts is not as fast.

It is therefore possible to proceed in the following way to adapt the inclination of the target support plate:

- in light of an expected shooting power, resulting for example from the last power recorded, it is determined whether or not it exceeds the limit of the elastic deformation capacity of the plate,
- if this is the case, the plate is tilted according to the two axes with angular values $\alpha$ and $\beta$ that are sufficient so that the power perceived on the plate is less than the aforementioned elastic deformation capacity,
- if the deformation of the target representation exceeds the maximum permissible dimensions on the abscissa: $\alpha$ is increased and $\beta$ is decreased or the material is changed for the target support plate,
- if the deformation of the target representation exceeds the maximum permissible dimensions on the ordinates: $\beta$ is increased and a is decreased or the material is changed for the target support plate.

In terms of materials, the plate 10 or 20 can be chosen, according to the desired applications, from polycarbonate, glass that may be bulletproof, steel alloy, etc. It is suitable to choose such and such a material according to its transparency and/or resistance to the expected projectiles. With regards to any prefabricated support of each target representation deformation, if a resistant opaque support is desired, the target representation deformed or not can be formed on this support via etching, screen printing, chemical or electrochemical etching via galvanoplasty or electroplating, or insertion of color into the mass.

Figure 6:
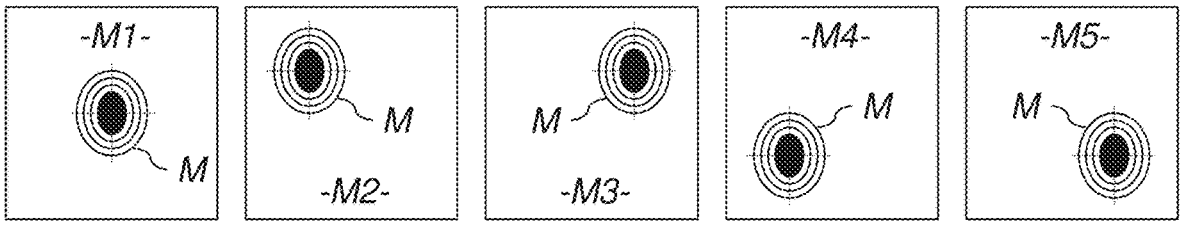

FIG. 6 shows another aspect of the invention, different and independent from the two mentioned hereinabove. This entails according to this other aspect providing several target representations that reproduce the same pattern M but intended to be centered on respectively several target centers located at different locations of the display plane of the target support plate 10 or 20. For example, a first representation M1 places the sight center at the center of the display plane, while a second representation M2 place it at the top left of the display plane, while a third representation M3 places it at the top right of the display plane, while a fourth representation M4 places it at the lower left of the display plane and while a fifth representation M5 places it at the lower right of the display plane. The five target representations of FIG. 6 are moreover shown according to the same deformation, knowing that multiple deformations can be displayed for each one of them.

According to this other aspect of the present invention also, the successive locations and powers of shooting impacts recorded in the memory 28 are supplied to means for selecting a target center location for a display that allows for a distribution that is as homogeneous as possible of the impacts in the display plane. The successive locations can respectively be weighted by the associated impact powers. It is thus possible to define in real time a two-dimensional map of the potential damage of the target support plate and position the sight center in the zones that are the least impacted. Concretely, the impact surface can be squared into zones wherein the recorded impact powers are progressively added, for a displacement of the sight center to the zones that are less impacted. This makes it possible to increase the service life of the target support plate 10 or 20. In the embodiment of FIG. 2, the means for selecting are advantageously implemented in the second calculator 32 which can, at each starting or reset, position the sight center in the zone that is the least weakened in light of the history of the impacts recorded in the memory 28. In the embodiment of FIG. 1, a man-machine interface can recommend the use of such and such target representation with a target center that is optimized according to the knowledge of weakened zones.

Figure 7:
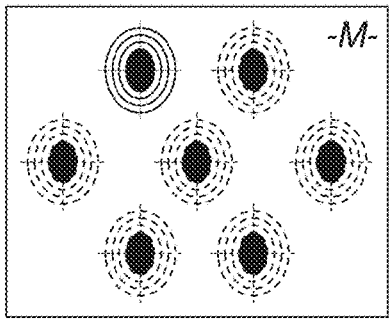

FIG. 7 shows an alternative of FIG. 6 according to which the different target representations that reproduce the same pattern M placed at different locations are grouped together on the same support or in the same general representation. In this case, a cover must be provided in order to display only the desired representation from among all of those possible.

Figure 8:
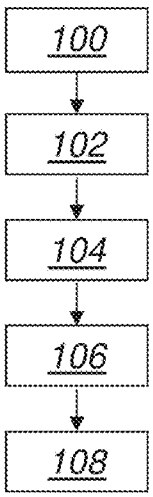
FIG. 8 shows the successive steps of a method for configuring the facility of FIG. 2.

Finally, FIG. 8 shows the successive steps of a method for configuring a shooting range facility for recreational or sporting purposes such as that of FIG. 2. For the execution of this method, the facility must a minima comprise a target support plate which can be tilted according to least one non-zero inclination in relation to reference plane P and at least one reference target representation, i.e. without deformation, intended to be displayed in a plane of the plate when the latter is parallel to the reference plane P.

During a first step 100, a target representation is chosen by a user for the purposes of a predetermined recreational or sporting activity.

During an optional second step 102, successive locations of shooting impacts recorded in the memory 28 allow the second calculator 32 to select an optimum target center location for the chosen target representation.

During an optional third step 104, one or several angle(s) of inclination, according to one or several axe(s) of the reference plane P, is or are determined in light of one or several shooting powers previously estimated and recorded. The resulting inclination is applied to the target support plate 20. By default, a non-zero inclination can be chosen by the user himself and/or measured by the detector 36.

During a fourth step 106, a deformation of the target representation chosen and selected in the steps 100 and 102 is calculated by the second calculator 32 using the angular value(s) of the inclination determined or measured in the step 104. This calculation is performed as indicated hereinabove in such a way that the orthogonal projection of the deformation in the reference plane P is identical to the reference target representation when the deformation is tilted according to the inclination determined or measured in the step 104.

During a fifth and last step 108, the calculated deformation is displayed in the plane of the plate 20 when the latter is tilted according to the inclination determined or measured on the step 104. Thus, the shooter sees the target representation without deformation when he is aiming according to the axis A perpendicular to the reference plane P.

It clearly appears that a shooting range facility for recreational or sporting purposes such as one of those describe hereinabove makes it possible to view a target representation without deformation regardless of the inclination chosen or selected from among several possible inclinations, of which at least one is non-zero, in order to protect the target support plate from high-power impacts. In the embodiment of FIGS. 2, 3 and 4, such a facility can furthermore be designed without consumable items.

Note moreover that the invention is not limited to the embodiments described hereinabove. It will appear indeed to those skilled in the art that various modifications can be made to the embodiments described hereinabove, in light of the teaching that has just been disclosed to them. In the presentation of the invention which is done beforehand between page 2 line 17 and page 4 line 33, the terms used must not be interpreted as limiting the invention to the embodiments disclosed in the present description, but must be interpreted to include therein all of the equivalents of which the foreseeing is within the scope of those skilled in the art by applying their general knowledge to the implementation of the teaching that has just been disclosed to them.

The invention claimed is:

1. A shooting range facility for recreational or sporting purposes comprising:

a target support plate configured to be tilted according to several different possible inclinations with respect to a reference plane; and at least one target representation configured to be displayed in a plane of the target support plate, wherein each target representation has several different displayable deformations, respectively associated with said several different possible inclinations, the different deformations being configured so that orthogonal projections thereof in the reference plane are all identical when the different deformations are respectively displayed in the plane of the target support plate according to the inclinations with which the different deformations are respectively associated.

2. The shooting range facility for recreational or sporting purposes according to claim 1, wherein each deformation of each target representation is reproduced on a prefabricated specific support configured to be removably arranged against the target support plate.

3. The shooting range facility for recreational or sporting purposes according to claim 1, further comprising:

a calculator programmed to calculate each deformation of each target representation using at least one angular value that corresponds to the inclination associated with the deformation; and a device configured to electronically display each deformation calculated by the calculator.

4. The shooting range facility for recreational or sporting purposes according to claim 3, further comprising:

a detector of the inclination of the target support plate for the supply of said at least one angular value, the calculator then being programmed to calculate the deformation of each target representation corresponding to the inclination detected by angular correction using said at least one angular value supplied by the inclination detector.

5. The shooting range facility for recreational or sporting purposes according to claim 3, wherein the device configured to electronically display each deformation calculated by the calculator is a computer screen, an interactive tablet, a flat screen, an image projector, a video projector, or a laser projector.

6. The shooting range facility for recreational or sporting purposes according to claim 1, wherein the target support plate is configured to be tilted angularly around a first main axis of the reference plane and/or around a second axis of the reference plane, perpendicular to the first main axis.

7. The shooting range facility for recreational or sporting purposes according to claim 6, wherein the first axis is configured to be substantially horizontal when the facility is installed on the ground.

8. The shooting range facility for recreational or sporting purposes according to claim 6, wherein:

any inclination of angle $\alpha$ around the first main axis generates a corresponding proportional geometrical deformation in $(\cos \alpha)^{-1}$ in the direction orthogonal to the first main axis of each target representation, and/or any inclination of angle $\beta$ around the second axis generates a corresponding proportional geometrical deformation in $(\cos \beta)^{-1}$ in the direction orthogonal to the second axis of each target representation.

9. The shooting range facility for recreational or sporting purposes according to claim 1, wherein the target support plate is transparent or translucent, has a front frosted face, and has a rear face against which is configured to be projected said at least one target representation in order to form the display plane of the target support plate.

10. The shooting range facility for recreational or sporting purposes according to claim 1, further comprising:

a device configured to locate shooting impact;

several target representations that reproduce the same pattern but configured to be centered on respectively several target centers located at different places on the display plane of the target support plate;

means for recording successive locations and powers of shooting impacts supplied by the device for locating; and means for selecting a target center location for a display selected according to the successive locations and powers of shooting impacts recorded.

11. The shooting range facility for recreational or sporting purposes according to claim 10, wherein the device configured to locate shooting impact includes at least three transducers and an electronic central unit connected to the transducers.

12. A method for configuring a shooting range facility for recreational or sporting purposes comprising a target support plate which is configured to be tilted according to several different possible inclinations with respect to a reference plane and at least one target representation configured to be displayed in a plane of the target support plate, the method for configuring comprising:

calculating several different displayable deformations of said at least one target representation using at least one angular value corresponding to each of said several different possible inclinations in such a way that the orthogonal projections of the several different displayable deformations in the reference plane are all identical when the is several different displayable deformations are tilted according to said respective several different possible inclinations corresponding thereto; and displaying each of said several different displayable deformations in the plane of the plate when respectively tilted according to each of said several different possible inclinations.

* * * * *